US007204343B1

(12) United States Patent
Seaman

(10) Patent No.: US 7,204,343 B1
(45) Date of Patent: Apr. 17, 2007

(54) COLLAPSIBLE PLATFORM FOR MAINTENANCE TASKS

(76) Inventor: Chris Seaman, P.O. Box 129, Bardwtown, KY (US) 40004

( * ) Notice: Subject to any disclaimer, the term of this patent is extended or adjusted under 35 U.S.C. 154(b) by 376 days.

(21) Appl. No.: 10/867,486

(22) Filed: Jun. 14, 2004

Related U.S. Application Data

(60) Provisional application No. 60/477,805, filed on Jun. 11, 2003.

(51) Int. Cl.
*A47B 85/06* (2006.01)
*A47B 3/02* (2006.01)

(52) U.S. Cl. ..... 182/29; 108/118

(58) Field of Classification Search ..... 182/28, 182/29, 30; 108/116, 117, 120, 118, 119, 108/145
See application file for complete search history.

(56) References Cited

U.S. PATENT DOCUMENTS 167,886 A * 9/1875 Field ..... 108/119
415,841 A * 11/1889 Lee ..... 108/119
526,570 A * 9/1894 Gonser ..... 182/29
996,533 A * 6/1911 Stafford ..... 182/29
1,423,366 A * 7/1922 Snook ..... 182/29
3,329,104 A * 7/1967 Gittings ..... 108/117
4,249,636 A * 2/1981 Jackson et al. ..... 182/152
4,760,801 A * 8/1988 Campbell ..... 108/119
5,086,711 A * 2/1992 Matthews ..... 108/119
6,974,185 B2 * 12/2005 Hsieh ..... 108/117

FOREIGN PATENT DOCUMENTS

AU 138709 S 10/1999
NZ 28602 5/2002

* cited by examiner

*Primary Examiner*—Hugh B. Thompson, II

(57) ABSTRACT

A collapsible platform having a scissor-like legs, a maintenance platform, a ladder to mount the platform, and a removable pin for a plurality of slots to raise the platform to different heights, and when the pin is removed, the apparatus lies flat for storage.

7 Claims, 4 Drawing Sheets

COLLAPSIBLE PLATFORM FOR MAINTENANCE TASKS

This application claims the benefit of the filing date of U.S. Provisional Application 60/477,805, filed Jun. 11, 2003.

SUMMARY OF INVENTION

The following gives a written description of the structure and operation of the inventive combination comprising a platform ladder, which is collapsible and raiseable to adjustable-height using a spring assist, and which is portable and step-mountable, and which is structured for safety and to avoid tipping.

BACKGROUND OF THE INVENTION

Previously, maintenance personnel could use a ladder or scaffolding when they had to work at a height above the ground. The problem with a step ladder, as well as an extension ladder, was that it had to be moved repeatedly to complete a task, and the ladder did not provide much facility for tools needed for the tasks. The alternative of scaffolding is the size and weight of these units, and although some scaffolds can provide a platform, the height of the platform only could be adjusted by demounting it and reconfiguring the elements of the scaffold. The ladder and the scaffold typically have to be lifted to be moved, and so have limited portability. A need existed for a maintenance platform, which is adjustable in height and which is step-mountable and portable, as well as a collapsible maintenance platform, having provisions for tool storage and safety rails, according to the description, drawings and claims of the present invention.

BRIEF DESCRIPTION OF THE DRAWINGS

In the accompanying Figures, the platform ladder is depicted, as follows.

DETAILED DESCRIPTION

Figure 1:
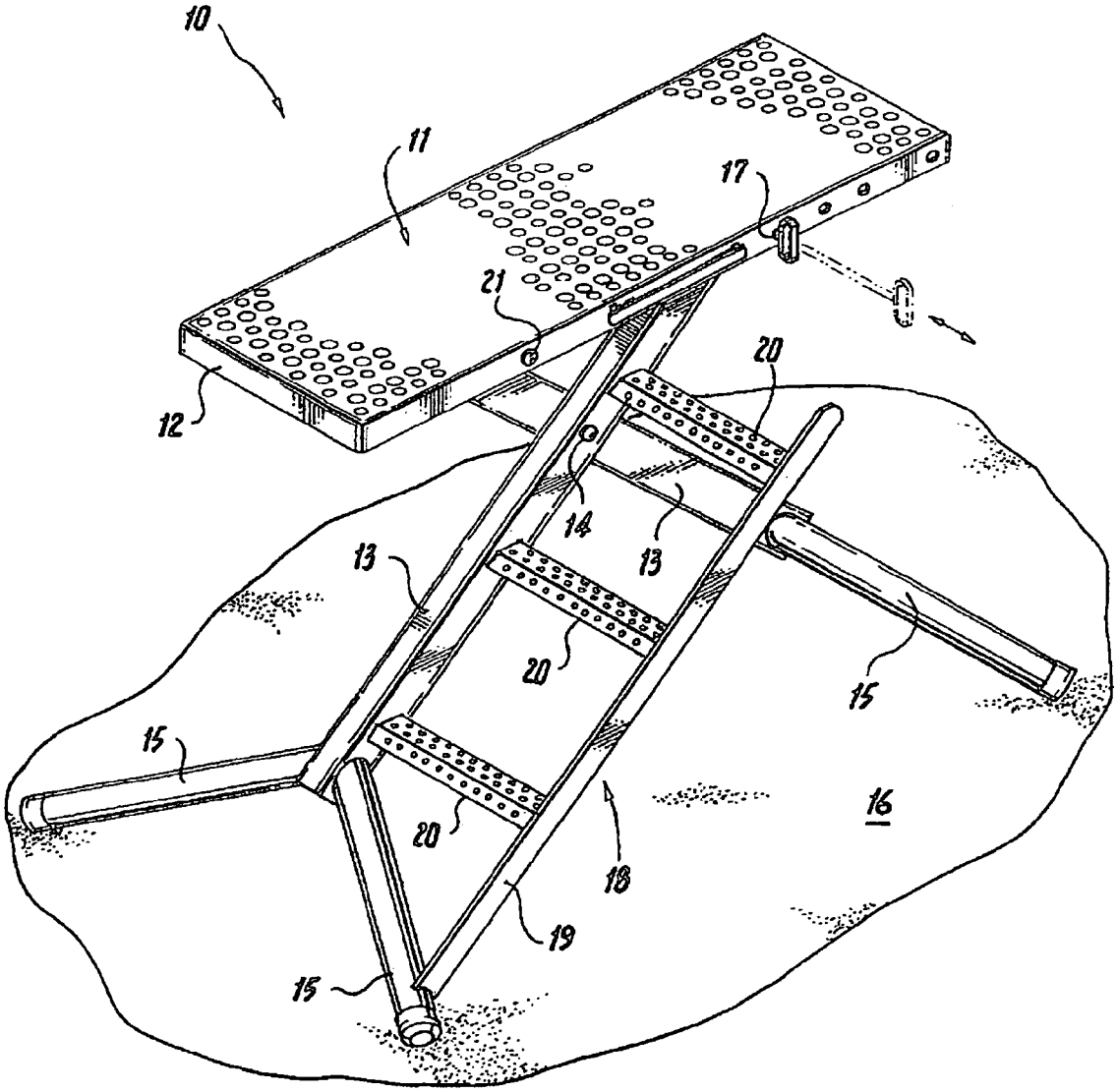
In FIG. 1, the apparatus is shown, with the platform raised and the legs upon a ground surface.
Figure 2:
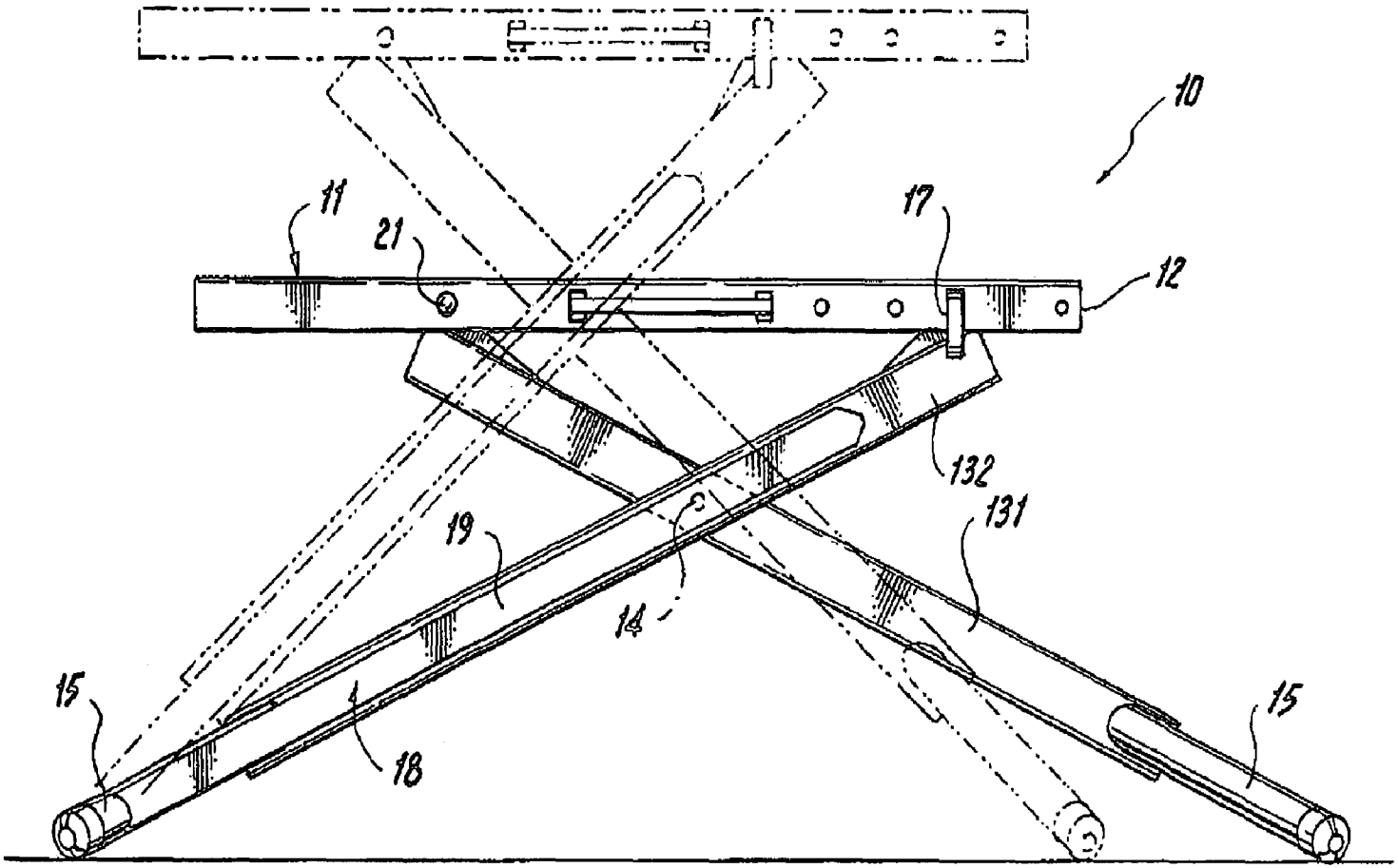
FIG. 2 depicts the apparatus from the side, with the platform raised.

The platform ladder (10) has a platform (11), which is planar and generally rectangular, but other shapes could make workable platforms. The top of the ladder platform differs in its length and its width. Along the edges of the platform are preferably sides that are folded twice to create a 2" side panel (12) and a ¾" lip which runs parallel to the top of the platform. The platform is supported upon leg rails (13). These rails are joined at a pivot point near their mid-length, as are scissors. The leg rails form an "X" underneath the ladder platform, when the platform ladder is set up for use. A bolt is run through both leg rails near their mid-length to form a center axis, and the rails pivot on this bolt (14). Both these leg rails have lower legs (15) that spread apart at the lower end of the leg rail, preferably in a V shape, and these lower legs are to contact the ground surface on which the platform ladder will be positioned. These leg rails connect to the underside of the platform, using pins.

One leg rail connects to the platform with a fixed pin (21), the second leg rail has a removable pin (17). In a simple arrangement, the first leg rail would have a hole in its top end, and a fixed pin would pass through the rail, and within a wing bracket on the underside of the platform. This wing bracket is preferably formed of a V-shaped or U-shaped portion, through which the pin is passed, and flat wing portions that attach to the underside of the platform. This bracket is a form of a channel through which the pin is passed from the front edge of the platform through the back edge panel. A pin, or bolt, of a diameter less than the holes in the leg rail and platform would connect these parts together, and that pin and channel arrangement would allow the leg rail to rotate about the pin or bolt connected to the platform. That fixed pin which connects this first leg rail would be secured, such as with a locking bolt, since the pin is not intended to be removed during normal use of the platform ladder. Preferably, this first leg rail is at or near the midline of the ladder platform. In another embodiment of the rail and fixed pin, the leg rail does not have an opening at its top end, rather a bracket is attached to that end, through which the fixed pin is passed through an opening between the bracket and the leg rail. This arrangement may be a flat end piece welded to the top end of the leg rail at a right angle, covering the end of the leg rail and extending off said end. The extended portion of this top plate joins to a wing plate that angles from the top plate back to the leg rail, forming an open area through which the pin would be inserted. In side view, the parts are arranged in a right triangle, with the leg rail being the base and the wing plate being the hypotenuse.

The combination of a bracket and fixed pivot pin securing the leg is improved by having a coil spring wound on the bracket that winds around to the leg rail. This spring provides an assist to the raising of the platform, by the spring imposing a force against the leg rail that favors that rail being in the position it has when the platform is raised. The spring helps to lift the weight of the platform from ground level to a working height. The platform may weigh around 40 lbs., and having the spring assist reduces that measurably. Also, the spring makes the movement of the platform from one height to another a smoother operation. In another embodiment, there is a spring that connects near the fixed pivot pin and extends to the second leg rail, and generally along the planar side panel, so that the spring imparts a force that pulls the top ends of the leg rails closer together, which assists in raising the platform and in inserting the removable pin. The spring force must be predetermined in relation to the weight of the platform and the force needed to raise it to a working height.

The first leg rail (131) has two lower legs that extend away from the rail, and away from the centerline of the platform along which the first leg rail runs. The lower legs extend from the leg rail preferably at least one and a half times the width of the platform, which provides stability to the platform.

The second leg rail (132) has an opening to receive a removable pin. This pin passes through the side panel edge of the platform, and then through the opening in the second leg rail and a wing bracket. The wing bracket is an embodiment of a pin channel, and the channel can be made in a variety of shapes for insertion of the pin. The side panel of the platform would have a series of openings in that edge, such that the second leg can be connected by a pin in any one of these openings. The different pin holes spaced along that edge allow the pin to be inserted in different locations along the edge of the platform. By these means, the ladder may be raised to be used with the platform at different heights. The plurality of pin slots permits the working height for the platform to be adjustable. As the distance is shortened between the connection points on the platform for the two leg rails, the platform will be elevated higher than when the distance between the connection points is lengthened. Preferably, this second leg rail is at or near the edge of the ladder platform, that is between the midline of the platform where the first leg rail is preferably fixed, and the folded edge of the platform through which the removable pin is inserted.

In this embodiment, the second leg rail has a structural feature that fits inside a channel on the underside of the platform, so a to provide a sliding mechanism. The channel is structured so that the pivot pin can be passed through the opening in the upper end of the second leg rail. This sliding arrangement allows the upper leg rail to be retained in the channel, and to slide back and forth under the ladder platform, at the place at which it is pinned. Another arrangement has the top plate and wing plate structure, described above, attached to the top end of the second leg rail. Joined within the area provided between the rail and the plates, is a cylinder or pipe, sized to removably accept the pivot pin. Alternatively, this cylinder would contact the removable pin which passes through the side panels of the platform. The preferable cylinder is dimensioned to extend between the folded edges on opposite longitudinal sides of the platform, such that the pivot pin passes through the first, or front edge, then through the cylinder or alongside the path of the cylinder, then out the second or back edge of the platform. Also, a preferred embodiment would have sliders on each end of cylinder, which reside in a channel formed by the folder edges of the platform, or it would have round slider, or wheel elements that roll in that channel and along the underside of the platform. These elements assist the movement of the second leg rail from one position where the pin may be inserted to a different position to be pinned.

The removable pin preferably would be provided with a cotter pin that holds the removable pin in a locked position in the edge of the platform. This cotter pin can be placed between the edge of the platform and within the removable pin when it is in one of the locations used to raise the platform.

A further important feature of the second leg rail is a runged ladder (18) used to step from the ground level up onto the ladder platform when it is raised. This ladder is joined to the second leg rail as follows. Parallel with second leg rail is the ladder rail (19), which is joined to the lower leg which extend from the leg rail out to the end of the lower leg. As described above, the lower legs extend from the leg rail, angling out to the point where these would contact the ground, and they extend out preferably no less than one and a half times the width of the platform. In the preferred embodiment, the rungs (20) are joined between the leg rail and the ladder rail. In that preferred arrangement of the second leg rail is that it runs underneath the platform at or near its first, or front edge, that arrangement places the ladder rail and most of the width of the rungs away from, and not underneath that edge of the platform. In this arrangement, when the platform is raised, the ladder is accessible for use to step then onto the platform.

In the preferred embodiment, the second leg rail has the following features, the rail, the legs that contact the ground, the structural element that resides in the track or channel on the underside of the platform, and the ladder rungs.

An important feature of the ladder rungs are step portions that have a surface that provides low friction area such that the steps are more safe to step on. The use of abrasive or non skid surfaces provides this, as does having the rungs formed of metal with raised cleats or diamonds that provide low friction points of contact between the rung surface and that of the footwear on the person stepping up the ladder onto the raised platform.

It is understood from the foregoing that as the platform is raised from its storage position, where the leg rails are flush with the underside of the platform, to its raised positions, that the angle of the leg rails changes in relation to the ground plane and the plane of the platform. Thus, by way of example and without limitation, the platform may be raised to a height, such that the second leg rail and its attached ladder rail are at a 20 degree angle in relation to the ground plane and generally the same angle in relation to the platform; and further, the platform may be raised to a higher elevation such that the leg rail angle is closer to 45 degrees. In the preferred embodiment, the rungs will have low friction surfaces around the rungs to contact with the footwear of the user, whether the ladder rail is at the 20 as well as the 45 degree angle. An improvement that provides this is a rung that has more than one flat surface, such that when the ladder rail is at the 20 degree angle, a first rung surface is generally parallel with the plane of the ground. Then should the ladder rail be at the 45 degree angle, then the rung has a second rung surface, again which generally is parallel with the plane of the ground. This embodiment requires the rungs to have a polygonal shape, when viewed in cross-section from their end. The angles between the surfaces on the rung is predetermined according the locations provided from the removable pivot pin. Those locations determine the working height for the platform, and determine the angle of the ladder rail at the several working heights. It is preferred that the rung have more than one step surface that provides a generally flat step surface at more than one working height. In one working version, the rung had two treaded surfaces. The first treaded surface was parallel to the ground plane when the platform was at full height. A second treaded surface was at approximately an 130 degree angle to that first treaded surface. When the platform was at a lower working height, that second treaded surface generally was parallel with the plane of the ground and the plane of the platform. Thus, the user had a flat treaded surface to step on as the height of the platform and the angle of leg rail was changed.

Figure 3:
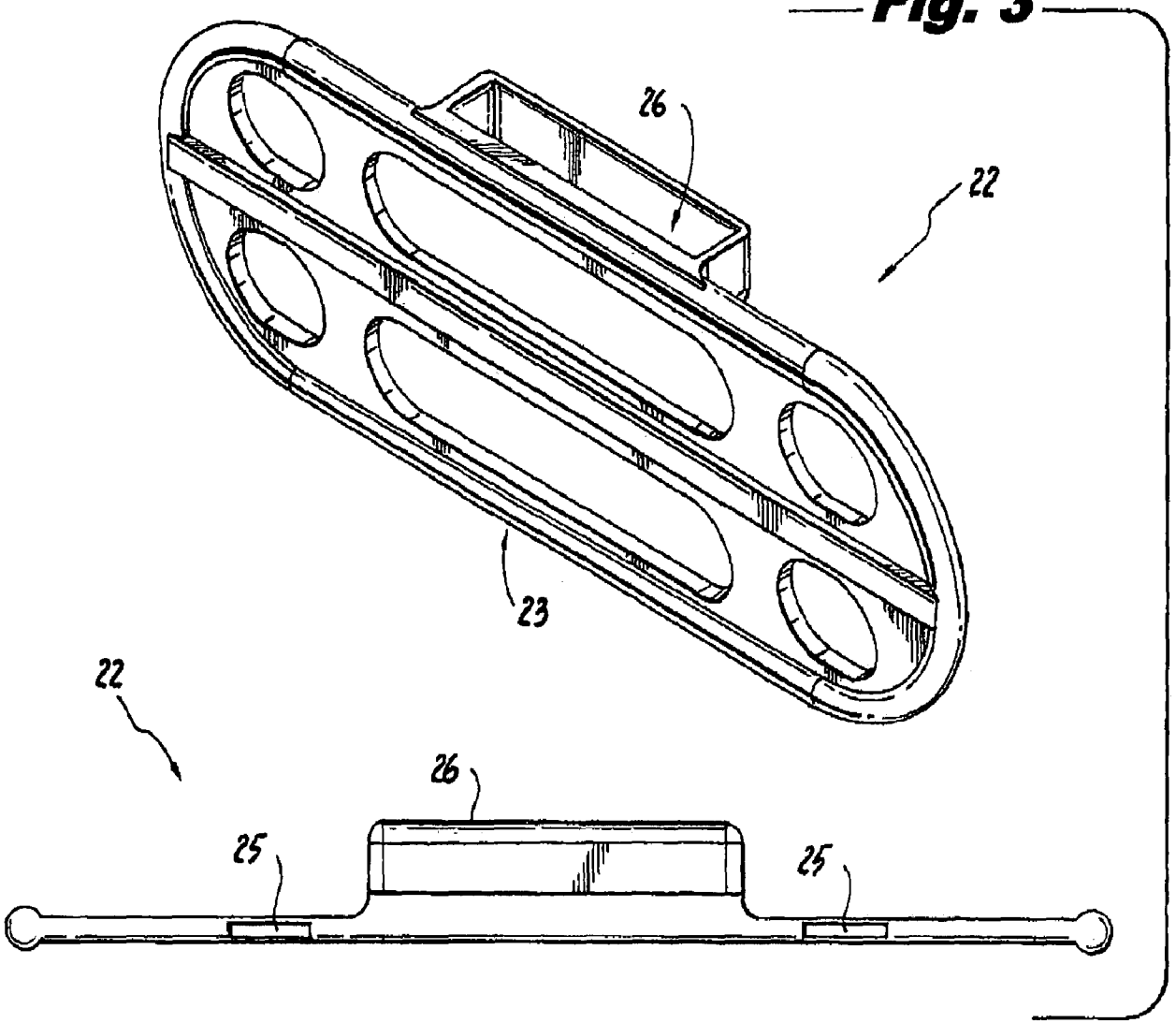
FIG. 3 has a top view and three-quarter view of a preferred embodiment of a hand rail.
Figure 4:
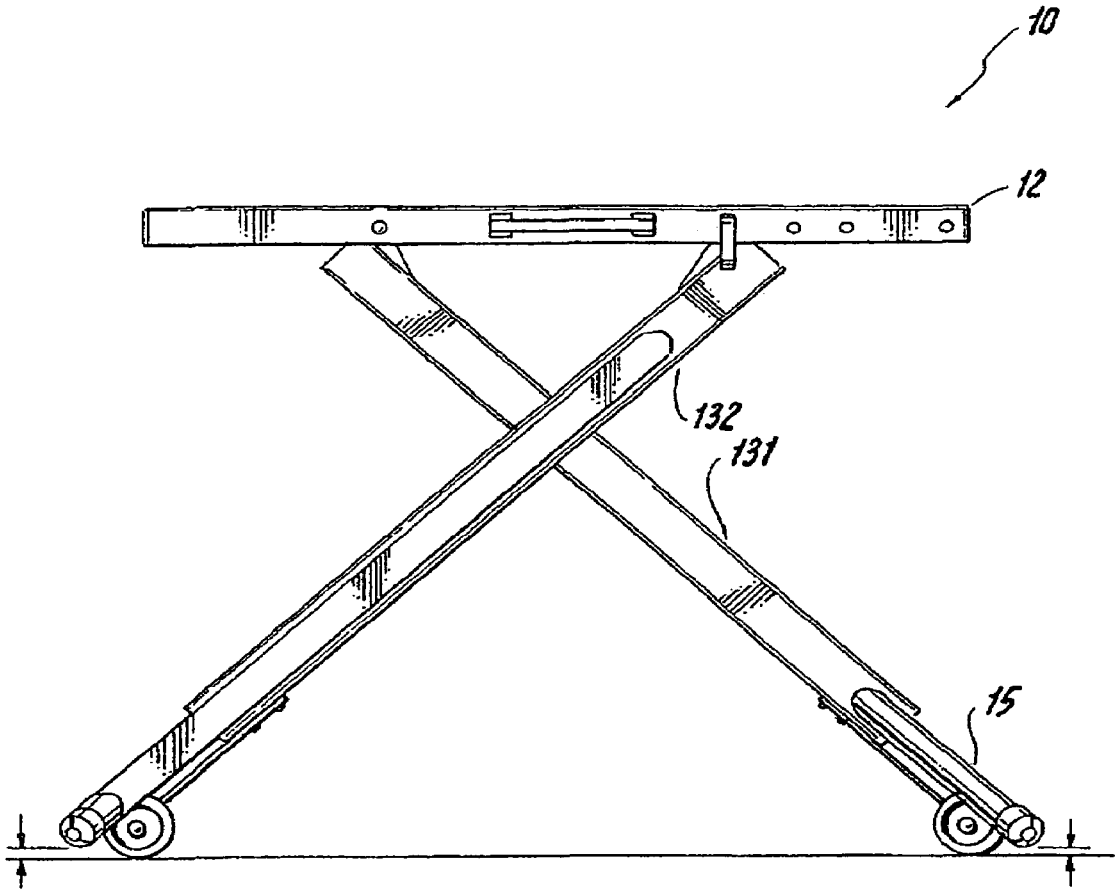
FIG. 4 depicts the apparatus from the side, with the platform in a raised position, and resting on the wheels and flexible end legs.

As an improvement to the apparatus, a hand rail may be attached removably to the rear edge of the top platform. In that arrangement, the ladder rail and rungs lead up to the front edge of the platform and along the rear edge (12), a railing (22) is removably attached. When the apparatus is raised, an a maintenance worker stands of the platform, the hand rail provides a measure of safety when overhead tasks are being performed. The worker may lean against the rail when looking up, or and one embodiment of the rail includes a tool rest or compartment (26) as part of the middle section. In the preferred embodiment as in FIG. 3, the rail is generally straight in its middle section (23), and each end has a downward curving section. The curved section (24), when the hand rail is removably attached to the platform, would be at or above the ends of the platform. The curved section provides the worker with a sensory indication that they are near the end of the platform. In that embodiment, the worker might be looking up and have one hand, or the lower part of the body, in contact with the rail. As the worker moves along the platform, the curved section indicates by touch that the worker is nearing the end of the platform, without the worker having to look down or look away from the maintenance task being performed. In this preferred embodiment, the rail is molded from a polymeric material, and it has slots (25) through it. An upright member would be attached, by typical hardware, to the rear panel (12) or into the edge of platform (11) near that rear panel. That upright member would have two rails, and one of those would go into each of the slots (25).

While the preferred structural embodiments of the invention are disclosed in the foregoing description, it is to be understood that it is not limited to those, and that the invention may be structured by equivalent embodiments.

I claim:

1. An adjustable, horizontal platform, comprising:

a top planar panel having beneath said planar panel, a first and a second pin channel, said first and second channels being parallel, and having a pin for each said channel, a support leg rail connected to said panel by said first pin through said first pin channel, a ladder leg rail connected to said panel by said second pin through said second pin channel, a leg of each said leg rail comprising a pair of members that spread away from each said leg rail, a pivot pin connecting said support leg rail and said ladder leg rail near the midpoint of each said rail, a plurality of rungs joined to said ladder leg rail said support leg rail further comprising a flexible end leg having a wheel and extending between said support leg rail members.

2. A collapsible platform, comprising:

A generally rectangular platform having a top planar panel extending to a front edge panel and a rear edge panel;

a first pin channel between said front edge panel and said rear edge panel, and a first pin therefor;

a second pin channel between said front edge panel and said rear edge panel, and a second pin therefor;

a spring connected between said first pin channel and to said second pin channel, said spring tensioned to pull said second pin channel toward said first pin channel;

a first leg rail connected by said first pin to said platform;

a second leg rail joined to said second pin channel, and said first and said second leg rails connected near their midpoint by a pivot pin;

a plurality of rungs joined to said second leg rail.

3. The collapsible platform of claim 2 further comprising a spring wound on said first pin channel to impart force between said platform and said first leg rail.

4. The collapsible platform of claim 2, wherein said front and said rear edge panel of said platform have at least one aligned opening sized for removable insertion of said second pin to extend through said front edge panel, through said second pin channel and through said rear edge panel.

5. The collapsible platform of claim 2, said front and said rear edge panel of said platform having a lip that generally is parallel to said top planar panel, and said second pin channel further comprising a cylinder having a slider at each end thereof, each said slider sized to be moveable between said lip and said top planar panel.

6. The collapsible platform of claim 2 further comprising a ladder rail joined to one said member on said ladder leg rail, and said rungs connected between said ladder rail and said ladder leg rail, to provide steps up to said top panel.

7. The collapsible platform of claim 2 further comprising, a wheel attached to each said leg rail and between said members.

* * * * *